US007571502B2

(12) United States Patent
Frano et al.

(10) Patent No.: US 7,571,502 B2
(45) Date of Patent: Aug. 11, 2009

(54) SEMI-RIGID ANTERIOR HEAD ALIGNMENT SYSTEM

(75) Inventors: Chris Frano, Brandenton, FL (US); Mitchell F. Komisar, Tallahassee, FL (US); David S. Pickett, Tallahassee, FL (US)

(73) Assignee: Sunrise Medical HHG, Inc., Longmont, CO (US)

( * ) Notice: Subject to any disclaimer, the term of this patent is extended or adjusted under 35 U.S.C. 154(b) by 335 days.

(21) Appl. No.: 11/548,534

(22) Filed: Oct. 11, 2006

(65) Prior Publication Data

US 2007/0145802 A1 Jun. 28, 2007

Related U.S. Application Data

(60) Provisional application No. 60/726,127, filed on Oct. 13, 2005.

(51) Int. Cl.
*A47C 7/36* (2006.01)
*A61G 15/00* (2006.01)

(52) U.S. Cl. ..... 5/622; 5/637; 5/640; 5/643; 297/391; 297/408

(58) Field of Classification Search ..... 5/622, 5/637, 640; 297/391, 393, 397, 408; 602/17; 128/845, 97.1
See application file for complete search history.

(56) References Cited

U.S. PATENT DOCUMENTS

| | | | | |
|---|---|---|---|---|
| 3,376,064 | A * | 4/1968 | Jackson | 297/391 |
| 3,643,996 | A * | 2/1972 | Carnahan | 297/410 |
| 4,183,583 | A | 1/1980 | Zuesse | |
| 4,545,572 | A * | 10/1985 | Day | 5/637 |
| 4,607,885 | A * | 8/1986 | del Fierro | 297/397 |
| 4,954,815 | A | 9/1990 | Delmonte | |
| 5,003,968 | A | 4/1991 | Mars | |
| 5,010,898 | A * | 4/1991 | de Kanawati et al. | 128/845 |
| 5,306,232 | A | 4/1994 | Whitmyer | |
| 5,332,287 | A | 7/1994 | Whitmyer | |
| 5,378,042 | A * | 1/1995 | Daneshvar | 297/393 |
| 5,511,854 | A | 4/1996 | Cordia | |
| 5,967,613 | A * | 10/1999 | McKeever | 297/397 |
| 7,350,250 | B2 * | 4/2008 | Froelich | 5/637 |
| 2002/0016561 | A1 * | 2/2002 | Prinsloo | 602/17 |

* cited by examiner

*Primary Examiner*—Michael Trettel
(74) *Attorney, Agent, or Firm*—MacMillan, Sobanski & Todd, LLC

(57) ABSTRACT

An anterior support for the head of a person seated in a wheelchair or other type of chair. The support can be pivoted from a position behind the chair to a position wherein a forehead strap engages the anterior portion of the head to hold the head adjacent a headrest pad. The forehead strap is attached to slide along one or more head bands which extend around the head to allow the head to turn without loss of support.

15 Claims, 5 Drawing Sheets

SEMI-RIGID ANTERIOR HEAD ALIGNMENT SYSTEM

CROSS-REFERENCE TO RELATED APPLICATIONS

Applicants claim priority to U.S. Provisional Patent Application Ser. No. 60/726,127 filed Oct. 13, 2005.

STATEMENT REGARDING FEDERALLY SPONSORED RESEARCH OR DEVELOPMENT

Not Applicable.

TECHNICAL FIELD

The invention related to a semi-rigid anterior head support system for supporting the head of a seated person, while permitting limited rotation of the head. The invention is particularly useful for wheelchair users with reduced musculature or muscle control of their neck and shoulders which cause their head to droop.

BACKGROUND OF THE INVENTION

Many physically challenged individuals have limited muscle tone in the shoulder and neck area or have limited nerve control of the muscles in the shoulder and neck area such that the person's head droops to the front or side. This positioning of the head creates discomfort, restricting their breathing, their ability to talk and communicate with others, and their ability to observe their surroundings. The inability to control head movement can increase the emotional impact of their disability.

U.S. Pat. No. 5,003,968, discloses one means for providing head support to such individuals. The patent discloses a complex system utilizing a helmet, a collar, chin support straps and elastic tethers. Rotational movement of the head is gained by rotating against an elastic tether.

Head straps and various braces have been used to maintain an individual's head in an upright position. However, the braces are usually very restrictive, permitting little head movement. Additionally, support systems that hold the chin in an upward position can prevent or restrict the person from eating or speaking.

U.S. Pat. No. 5,306,232 discloses an improved head alignment devise for holding the head in a generally vertical position without restricting movement of the chin and without restricting all voluntary movement of the individual's head. A head support strap or head band is positioned to extend around the individual's forehead. One end of the head band is connected to strings which extend around two spaced pulleys on a bar mounted behind the person's head to the other end of the strap. The length of the string is adjusted so that the head band gently holds the head against or close to a headrest. The pulleys allow the person to rotate his or her head, while the head band holds the head in a generally upright position against the headrest.

In prior art head support systems which include a head band, careful adjustment is required for the head band each time it is attached to support a head. If the head band is too loose so that tension may be released, for example, if the individual pushes against the resilient headrest, the head band may slip down over the eyes, the nose or the chin of the user. If the head band is too tight, the individual will be uncomfortable.

BRIEF SUMMARY OF THE INVENTION

The head support of the invention includes a bar or other member designed to be mounted on a wheelchair or other type of chair behind the head of an individual seated in the chair. Two resilient, low friction head bands extend from a first bracket mounted on the bar around the individual's head to a second bracket mounted on the bar. The head bands extend generally parallel to each other. Preferably, the head bands extend in a generally U-shaped configuration. The lengths of the head bands are adjusted at the brackets to accommodate the individual's head size with the pad held close to the forehead. As the individual turns his or her head, the pad slides on the head bands. The brackets which mount the head bands allow the head bands and pad to be rotated from a position supporting the individual's head to a position behind the head to allow the individual to be transferred into and out of the wheelchair. The brackets allow repeatable positioning of the forehead pad to an adjusted position specifically for the individual. The head bands have sufficient resiliency to prevent the forehead pad from falling below a set position on the individual forehead.

Various objects and advantages of the invention will become apparent from the following detailed description of the invention and the accompanying drawings.

DETAILED DESCRIPTION OF THE INVENTION

Wheelchairs for more severely challenged persons are frequently provided with custom body supports. For the head, these may include, for example, a single headrest pad, a contoured cradle head support which cradles the occiput and provides lateral cervical support, or a headrest pad combined with a single or a two sub-occipital head supports. The components for a head support are selected and adjusted based on the individual person's needs. A dynamic forehead support strap, as taught in U.S. Pat. No. 5,306,232, the disclosure of which is incorporated herein, also has been used in combination with these different types of head supports for providing anterior support. Forehead support straps are particularly useful for low muscle tone individuals with poor head balance, individuals exhibiting forward flexion patterns, and individuals who require an upright head position for medical reasons, for example, due to compromised respiration or swallowing.

Figure 1:
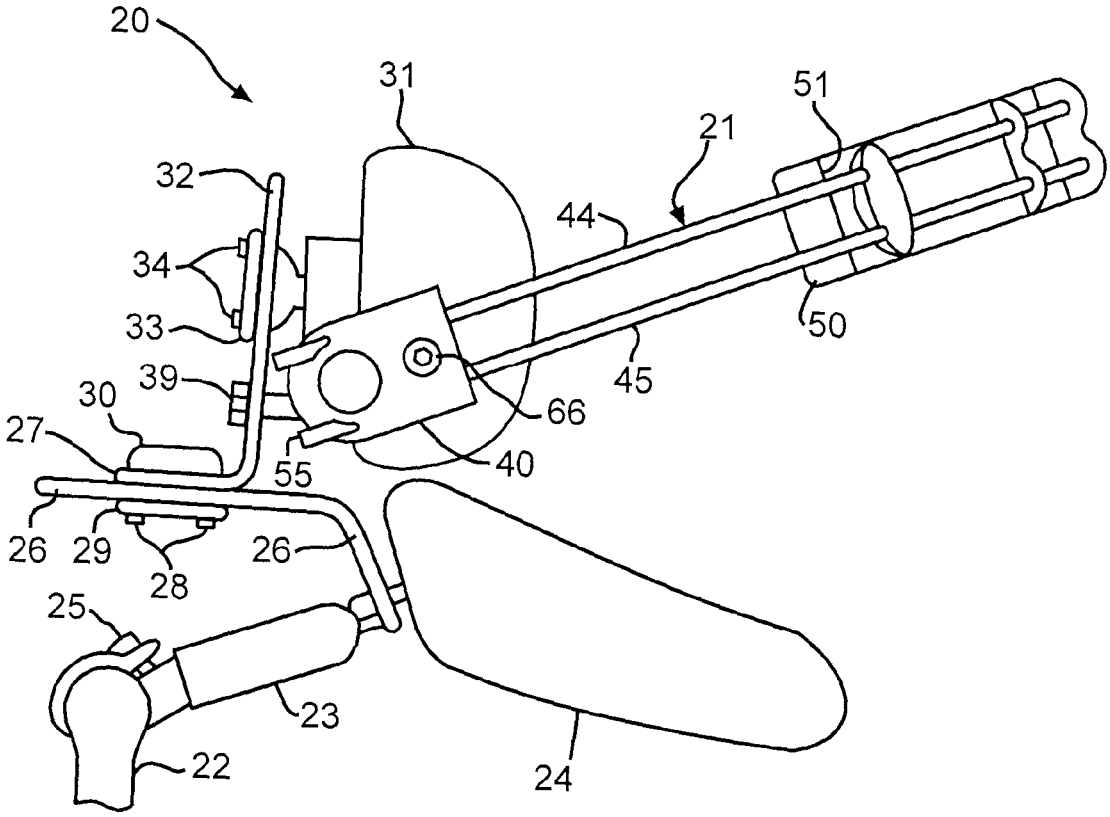
FIG. 1 is a side elevational view showing an exemplary head support system for a wheelchair user which includes a semi-rigid anterior head support according to the invention.

Referring to the drawings, FIG. 1, a fragmentary portion of a head support system 20 which includes a semi-rigid anterior head support 21 according to the invention. A vertical post 22 is mounted on one or more brackets (not shown) on the back of a chair which is typically a wheelchair (not shown). The post 22 may be vertically adjusted in the bracket and locked at the appropriate height for the person whose head requires support. A bracket 23 is clamped to the post. In the illustrated embodiment, a cradle pad 24 or one or two sub-occipital pads which provide lateral support to the neck to stabilize the head are mounted on the bracket 23. The bracket 23 may be rotated on the post 22 and clamped in place with a screw 25 for positioning the cradle pad 24. The cradle pad 24 also may be adjustably mounted on the bracket 23.

A second bracket 26 is secured to the bracket 23. A third bracket 27 is clamped to the bracket 26 using screws 28 which extend through a clamp 29 and engage a member 30. The screws 28 pass through elongated slots (not shown) in the second bracket 26 to permit adjustment of the forward and backward position of the third bracket. A headrest pad 31 is secured to a vertical leg 32 of the third bracket 27 via a clamp 33 and screws 34. The screws 34 may pass through a vertical slot (not shown) in the leg 32 to permit adjustment of the vertical position of the headrest pas 31 relative to the cradle pad 24. It should be appreciated that the above described head support system is known in the art and that its components may be varied to suit an individual's specific needs.

Figure 2:
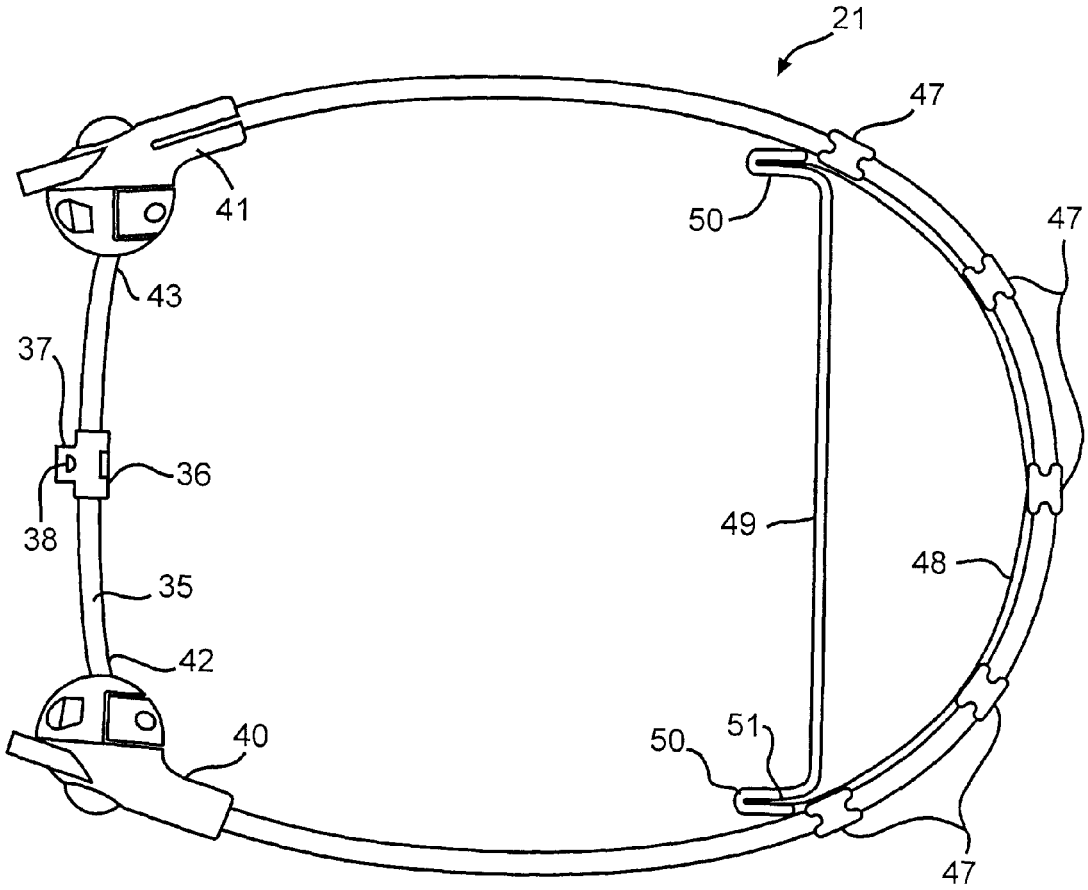
FIG. 2 is a top plan view of the semi-rigid anterior head support of the invention.
Figure 3:
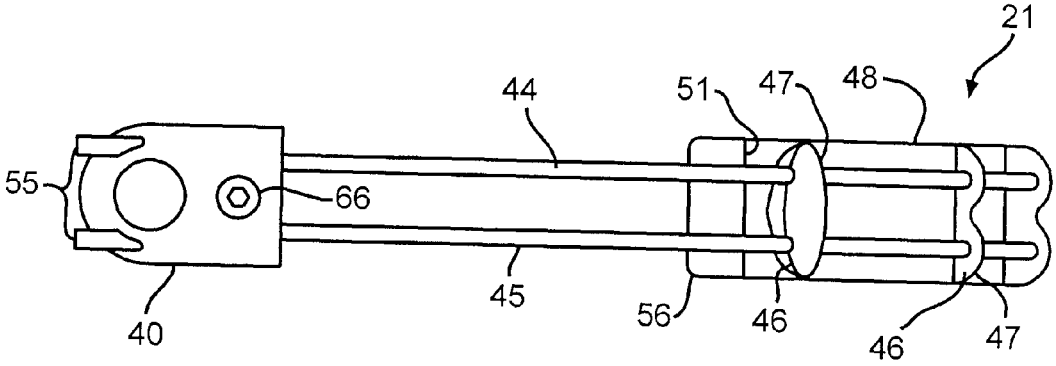
FIG. 3 is a side elevational view of the head support of FIG. 2.
Figure 4:
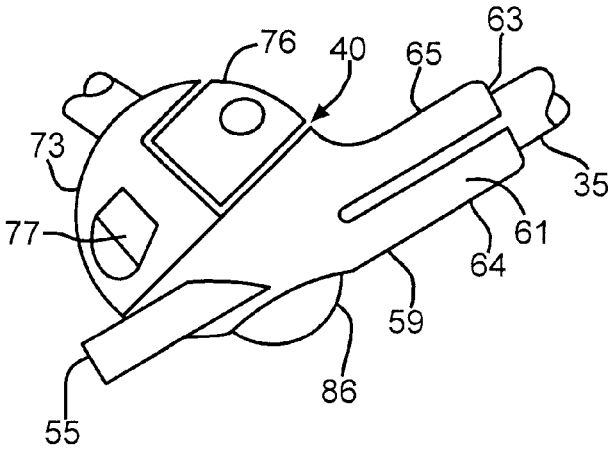
FIG. 4 is a top view of a pivot bracket for the head support of FIG. 2.
Figure 5:
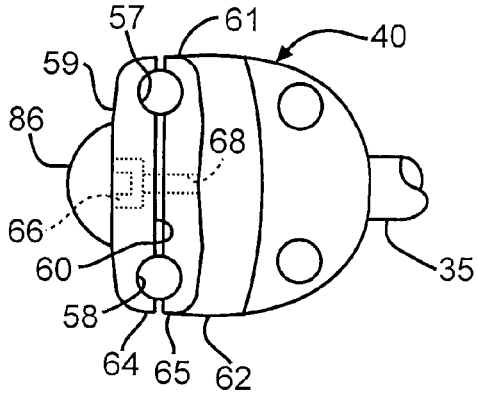
FIG. 5 is a front view of the pivot bracket of FIG. 4.
Figure 6:
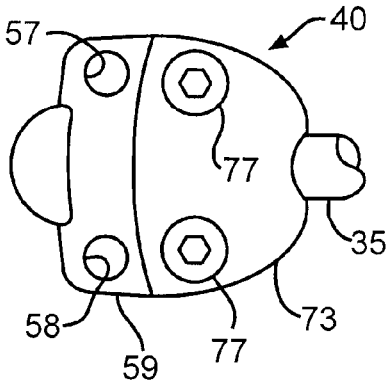
FIG. 6 is a rear view of the pivot bracket of FIG. 4.
Figure 7:
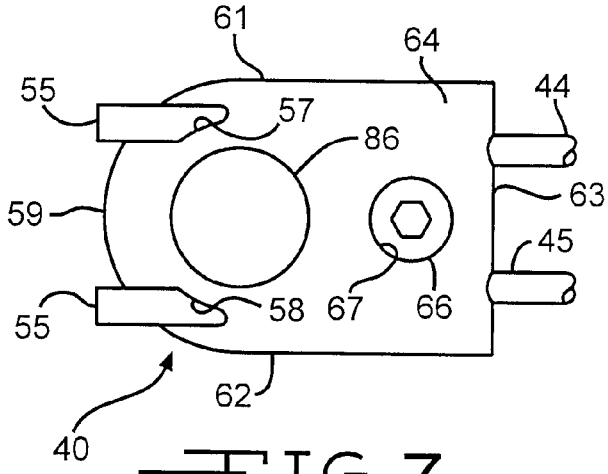
FIG. 7 is an outer side view of the pivot bracket of FIG. 4.
Figure 8:
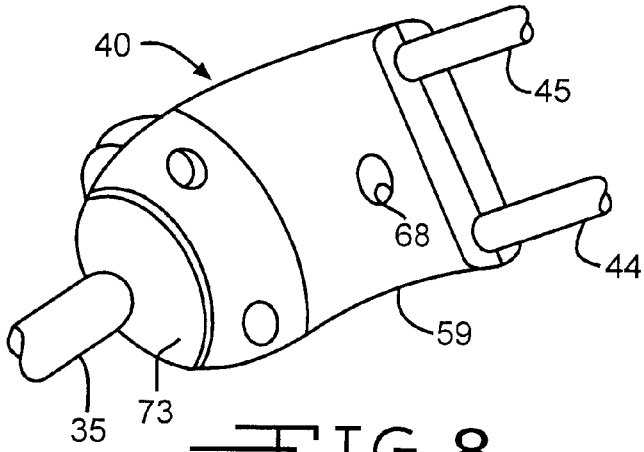
FIG. 8 is a inner side view of the pivot bracket of FIG. 4.

As best seen in FIGS. 1-3, the anterior head support 21 includes a horizontal bar 35 having a mounting block 36 welded to its center. The mounting block 36 has a rectangular projection 37 and a threaded opening 38. The horizontal bar 35 is secured to the vertical leg 32 of the bracket 26 using a bolt 39. The rectangular projection 37 extends into the vertical slot on the vertical leg 32 and functions to prevent rotation of the bar 35 so that it remains horizontal. It will be appreciated that other mounting arrangements may be used for mounting the anterior head support 21 on a chair.

Pivot brackets 40 and 41 are mounted on opposite ends 42 and 43 of the horizontal bar 35. Two resilient head bands 44 and 45 extend between the two pivot brackets 40 and 41. The head bands 44 and 45 are formed from a relatively stiff resilient material which is sufficiently flexible to allow bending into a generally U shape of a size for extending around a head which is supported by the anterior head support 21. The material should be smooth and have a relatively low surface friction, such as nylon. However, it will be appreciated that other materials also may be used for the forehead bands 44 and 45.

The head bands 44 and 45 extend through openings 46 in a plurality of guides 47 on a forehead strap support 48. The forehead strap support 48 has a curved surface 48 and may be integral with the guides 47 or attached to the guides 47. The guide openings 46 provide sufficient clearance with the head bands 44 and 45 to allow the forehead strap support 48 to easily slide along the parallel head bands 44 and 45 as a supported head is rotated.

For comfort, a forehead strap 49 extends between spaced ends 50 of the forehead strap support 48. For comfort, the forehead strap 49 may be made from a strip of fabric which can breathe. Pockets 51 sewn in the ends of the forehead strap 49 are slipped over the forehead strap ends 50 to secure the forehead strap 49 to the forehead strap support 48. Alternately, the forehead strap 49 may be of a rubber type material such as neoprene secured to the forehead strap ends 50, or of other types of materials.

As best seen in FIGS. 2-8, ends 55 of the two head bands 44 and 45 extend through holes 57 and 58, respectively, through a body 59 portion of the pivot bracket 40. A groove 60 is cut part way through the body 59 to extend between sides 61 and 62 and through the centers of the holes 57 and 58. The groove 60 separates an end 63 of the body 59 into two sections 64 and 65. A socket head screw 66 is seated in a counterbored opening 67 through the section 64 and engages a threaded opening 68 in the section 65. Tightening the screw 66 causes the head bands 44 and 45 to be clamped to the pivot bracket 40. The pivot bracket 41 is of a similar construction as the pivot bracket 40. By loosening the screw 66 in one or both of the pivot brackets 40 and 41, the anterior head support 21 may be adjusted so that the forehead strap 49 is in contact with the head while the head is in contact with the headrest pad 31. The forehead strap 49 and the headrest pad 31 cooperate to hold the held upright, while the flexibility of the head bands 44 and 45 and the ability of the forehead strap support 48 to slide along the head bands 44 and 45 allow the head to be rotated.

The pivot brackets 40 and 41 are designed to allow the head bands 44 and 45 and the attached forehead strap support 48 to rotate between a first position wherein a head is supported and a second position wherein they are positioned behind the head at a location which does not interfere with an individual being transferred into and out of the wheelchair. Rotational motion is limited in the first position to prevent the head bands 44 and 45 from falling below the forehead. In the second position, the head bands may be positioned behind the post 22 in FIG. 1.

Figure 9:
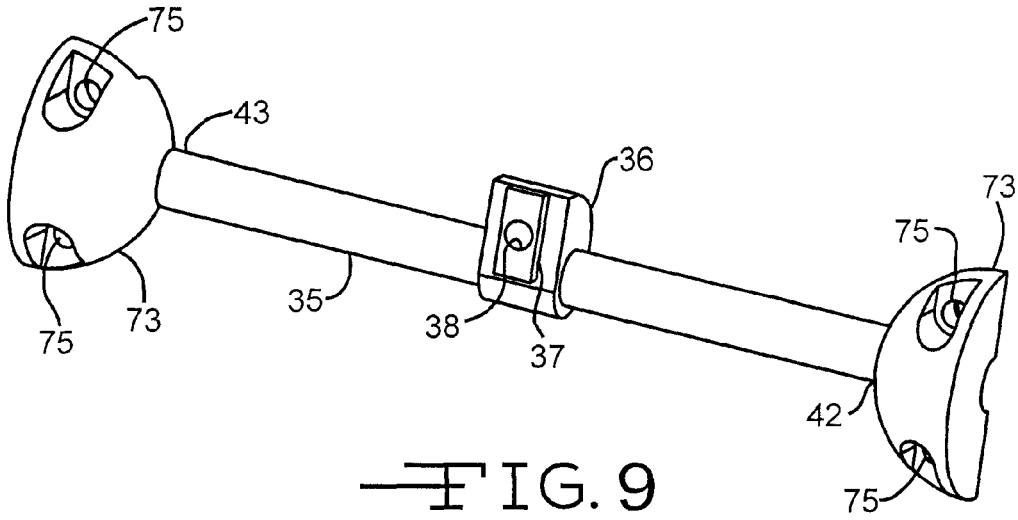
FIG. 9 is a rear perspective view of a horizontal bar with a mounting bracket welded to the center and a clamp body welded to each end of the bar.
Figure 10:
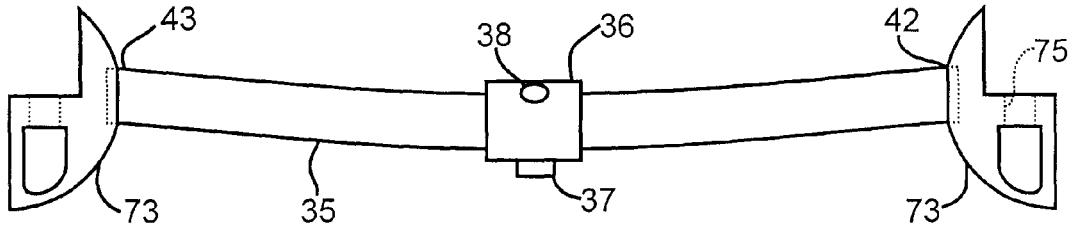
FIG. 10 is a top plan view of the horizontal bar of FIG. 9.
Figure 16:
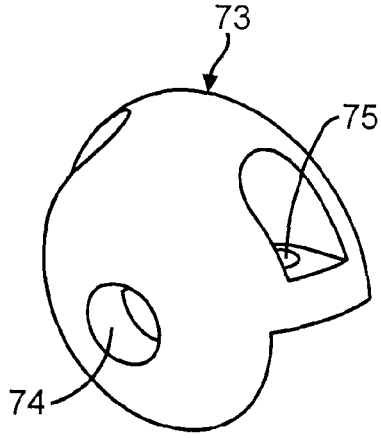
FIG. 16 is a perspective view of a clamp.

Details of the pivot bracket 40 and of the horizontal bar 35 are shown in FIGS. 4-16. As shown in FIGS. 9, 10 and 16, a separate clamp body 73 is welded or otherwise fixed to opposite ends 42 and 43 of the horizontal bar 35. The clamp body 73 at the end 42 forms a part of the pivot bracket 40 and the clamp body 73 at the end 43 forms a part of the pivot bracket 41. The has an opening 74 which received an end 42, 43 of the horizontal bar 35. Two spaced counterbored holes 75 extend through the body 73 for receiving screws, as will be described below.

FIGS. 4,-6, 8 and 15 show details of a clamp 76 which is secured to the clamp body 73 using two socket head cap screws 77. The clamp 76 has two spaced threaded holes 78 which are located to receive the screws 77 which are passed through the two holes 75 in the clamp body 73. The clamp 76 has an semicircular groove 79 extending between an inner side 80 and an outer side 81. An arcuate flange 82 extends into the groove 79 near the side 81.

Figure 13:
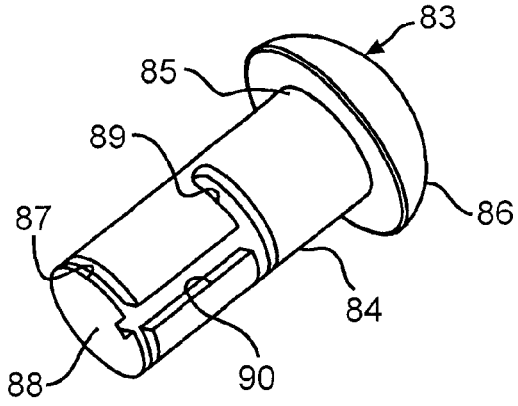
FIG. 13 is a perspective view of a pivot pin about which the pivot bracket body rotates.

FIG. 13 shows details of a pivot pin 83. The pivot pin 83 has a cylindrical shaft 84 which terminates at one end 85 with an enlarged diameter rounded head 86. An annular groove 87 extends around the shaft 84 adjacent an opposite end 88 of the shaft 84. When the pivot bracket 40 is assembled, the end 88 of the shaft 84 is clamped between the clamp 76 and the clamp body 73 to prevent movement of the pivot pin 83. The flange 82 extends into the groove 87 to further prevent longitudinal movement of the pivot pin 83 relative to the horizontal bar 35. A groove 89 spaced from the groove 87 extends part way around the shaft 84. The length of the groove 89 determines the amount that the pivot bracket 40 can rotate relative to the horizontal bar 35. The groove 69 may be of a length, for example, to allow the pivot brackets 40 and 41 to rotate through an arc of between about 120° and about 260°. A groove 90 extends from the shaft end 88 to the groove 89.

Figure 11:
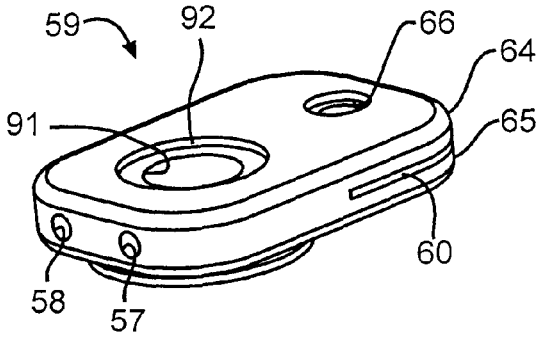
FIG. 11 is a perspective view of one side of the pivot bracket body.
Figure 12:
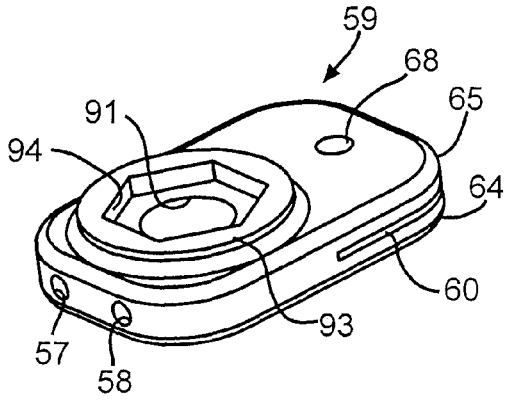
FIG. 12 is a perspective view of the reverse side of the pivot bracket body.

FIGS. 11 and 12 show additional details of the Pivot bracket body 59. A hole 91 extends through the body 59 for passing the shaft 84 of the pivot pin 83. The hole 91 has a counterbore 92 for receiving a portion of the pivot pin head 86. The hole 91 extends concentrically through a boss 93 on the opposite side of the body 59. A hexagonal recess 94 is formed in the boss 93 concentric with the hole 91.

Figure 14:
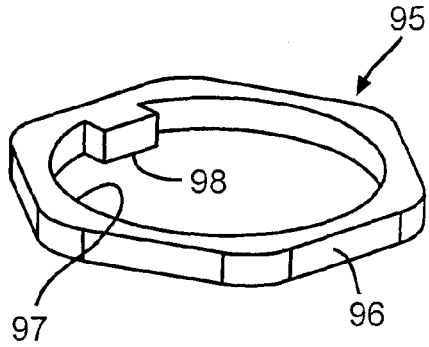
FIG. 14 is a perspective view of a pivot stop.
Figure 15:
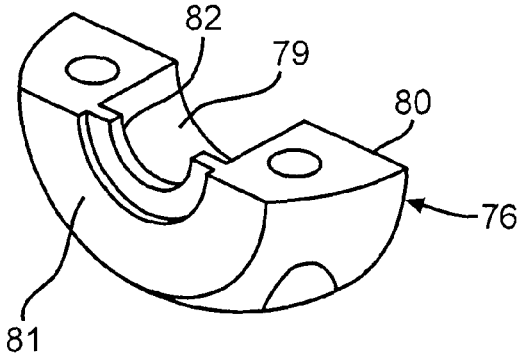
FIG. 15 is a perspective view of a clamp body.

FIG. 14 shows details of a pivot stop 95. The pivot stop 95 is flat and has a hexagonal outer edge 96 sized to be received by the hexagonal recess 94 in the body 59. The hexagonal edge 96 of the pivot stop 95 and the recess 94 cooperate to prevent rotation of the pivot stop 95 relative to the body 59. It will be appreciated that other arrangements may be used to prevent rotation of the pivot stop 95 relative to the body 59. The pivot stop 95 has a center opening 97 of the same size as the body opening 95 for receiving the pivot pin shaft 84. A key 98 projects a short distance into the opening 97. The key 98 is sized to pass through the groove on the pivot pin shaft 84.

The pivot bracket 40 is assembled by inserting the shaft 84 of the pivot pin 84 into the body opening 91. The pivot pin end 88 will extend from the boss 94. The pivot stop 95 is then passed over the shaft 84 and placed in the appropriate orientation in the recess 94. The key 98 will then be positioned to move in the groove 89 on the pivot pin shaft 89. It should be noted that the length of the groove 89 determined the length of the arc that the body 59 can rotate about the pivot pin 83. The pivot pin 83 is then secured to the bar 35 by tightening the clamp formed by the clamp body 73, the clamp 76 and the screws 77. As the clamp 76 is tightened, the flange 82 will extend into the groove 87 adjacent the 88 end of the pivot pin shaft 84. Before tightening the screws 77 for the clamp 76, the pivot in 83 is positioned in a desired orientation so that the forehead strap 49 will be held in the correct position when a head is being supported. If desired, an index mark may be placed on the pivot pin head 86 to facilitate alignment of the pivot pin 83 while the clamp 76 is tightened. The pivot pin head 86 also may be formed for receiving a tool to facilitate proper alignment of the pivot pin 83.

Figure 17:
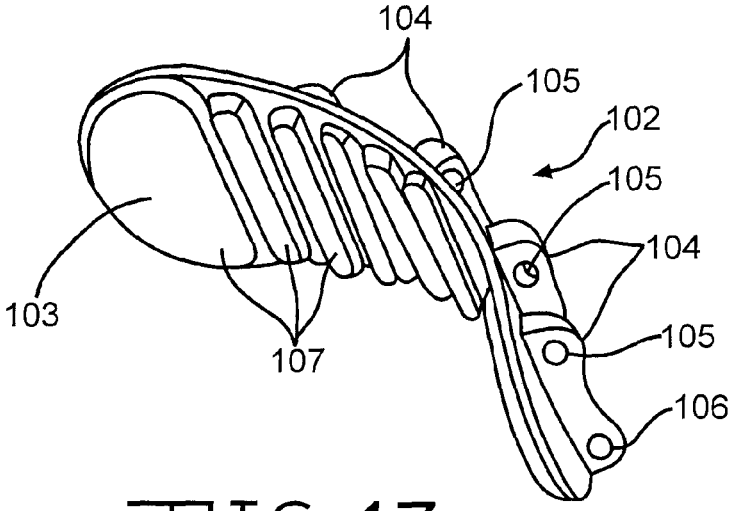
FIG. 17 is a perspective view of a forehead support pad.

FIG. 17 shows a forehead strap 102 which may be used in place of the above described forehead strap support 48 and forehead strap 49. The forehead strap 102 may be molded as one piece including a forehead support surface 103 on one side and a plurality of spaced guides 104 having two spaced head band openings 105 and 106 on an opposite surface. The forehead support surface 103 may be divided into a plurality of segments 107, as shown, or it may be continuous. The segments 107 may allow more breathing and be cooler than a solid surface. If the support surface 103 is solid, a soft foam pad may be attached to the surface for added comfort.

In a further embodiment of the invention, the a forehead strap may be made entirely from a fabric. The fabric is of a suitable length for supporting the head. A pocket is sewn along each lateral edge of the fabric. The pockets are parallel and are spaced for receiving a head band 44 or 45. If desired, the forehead strap may be padded to provide comfort for the user.

It will be appreciated that various modifications and changes may be made to the above described preferred embodiment of the anterior head support without departing from the scope of the following claims. The anterior head support has been illustrated and described as having two parallel head bands 44 and 45 on which the forehead strap support 48 or a forehead pad can slide. According to a further aspect of the invention, either only a single head band or more than two head bands may be used without departing from the invention. It also will be appreciated that other designs may be used for the pivot brackets 40 and 41 while providing the same function without departing from the invention.

The invention claimed is:

1. An anterior head support for a person seated in a chair comprising a bar adapted to be mounted on a chair to extend behind the head of a seated person, first and second pivot brackets mounted in a spaced relationship on said bar, at least one elongated resilient head band extending in a loop from said first pivot bracket to said second pivot bracket, said loop having a size for extending around a head of a person seated in the chair, and a forehead support mounted to slide on said at least one head band whereby a supported head of a person seated in a chair is not prohibited from turning to either side while the forehead support engages such person's forehead.

2. An anterior head support for a person seated in a chair comprising a bar adapted to be mounted on a chair to extend behind the head of a seated person, first and second pivot brackets mounted in a spaced relationship on said bar, at least one elongated resilient head band extending in a loop from said first pivot bracket to said second pivot bracket, said loop having a size for extending around a head of a person seated in the chair, and a forehead support mounted to slide on said at least one head band, and wherein said at least one elongated resilient head band comprises two resilient rods which extend substantially parallel to each other between said first and second pivot brackets.

3. An anterior head support, as set forth in claim 2, and wherein said pivot brackets rotate between a first position wherein said forehead support is positioned to support the head of a person seated in the chair and a second position wherein said forehead support is positioned away from the heat of a person seated in the chair.

4. An anterior head support, as set forth in claim 3, and wherein said forehead support includes a curved strap having a plurality of spaced guides each having two spaced openings for passing said two resilient rods.

5. An anterior head support, as set forth in claim 4, and wherein said curved strap has two end portions, and further including a fabric strap extending between said two end portions for engaging a forehead.

6. An anterior head support, as set forth in claim 4, and wherein said pivot brackets each include a clamp for securing said resilient rods to said pivot brackets whereby the size of said loop is adjustable.

7. An anterior head support, as set forth in claim 1, and wherein said pivot brackets rotate between a first position wherein said forehead support is positioned to support the head of a person seated in the chair and a second position wherein said forehead support is positioned away from the head of a person seated in the chair.

8. An anterior head support, as set forth in claim 7, and wherein said forehead support includes a curved strap having a plurality of spaced guides each having two spaced openings for passing said two resilient rods.

9. An anterior head support, as set forth in claim 8, and wherein said pivot brackets each include a clamp for releasably securing said resilient rods to said pivot brackets whereby the size of said loop is adjustable.

10. An anterior head support, as set forth in claim 1, and wherein said pivot brackets each include a clamp for releasably securing said at least one head band to said pivot brackets whereby the size of said loop is adjustable.

11. An head support system for supporting the head of a person seated in a wheelchair, comprising an adjustable mounting bracket adapted to be secured to a wheelchair, a headrest pad secured to said mounting bracket, and an anterior head support secured to said mounting bracket for holding the head of a person seated in a wheelchair generally vertical and against said headrest pad, said anterior head support including a bar secured to said mounting bracket to extend substantially horizontal, first and second pivot brackets mounted on said bar to be positioned behind and on opposite sided of a supported head, at least one elongated resilient head band extending in a loop between said first and second pivot brackets, said loop having a size for extending around a supported head, and a forehead support mounted to slide on said at least one head band.

12. An head support system, as set forth in claim 11, and wherein said pivot brackets rotate between a first position wherein said forehead support is positioned to support the head of a person seated in the chair and a second position wherein said forehead support is positioned away from the heat of a person seated in the chair.

13. An head support system, as set forth in claim 11, and wherein said at least one elongated resilient head band comprises two resilient rods which extend substantially parallel to each other between said first and second pivot brackets.

14. An head support system, as set forth in claim 13, and wherein said pivot brackets each include a clamp for releasably securing said two resilient rods to said pivot brackets whereby the size of said loop is adjustable.

15. An head support, as set forth in claim 11, and wherein said pivot brackets each include a clamp for releasably securing said at least one head band to said pivot brackets whereby the size of said loop is adjustable.

* * * * *